US008956129B2

(12) United States Patent
Murakami et al.

(10) Patent No.: US 8,956,129 B2
(45) Date of Patent: Feb. 17, 2015

(54) ELECTRIC COMPRESSOR

(75) Inventors: Kazuo Murakami, Aichi (JP); Kenji Mochizuki, Aichi (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 383 days.

(21) Appl. No.: 13/061,653

(22) PCT Filed: Jun. 17, 2009

(86) PCT No.: PCT/JP2009/061010

§ 371 (c)(1),
(2), (4) Date: Mar. 1, 2011

(87) PCT Pub. No.: WO2010/024021

PCT Pub. Date: Mar. 4, 2010

(65) Prior Publication Data

US 2011/0158833 A1 Jun. 30, 2011

(30) Foreign Application Priority Data

Sep. 1, 2008 (JP) ..... 2008-223694

(51) Int. Cl.
*F04B 17/00* (2006.01)
*F04B 39/14* (2006.01)
(Continued)

(52) U.S. Cl.
CPC ..... *F04B 39/14* (2013.01); *F04B 35/04* (2013.01); *F04B 39/121* (2013.01);
(Continued)

(58) Field of Classification Search
CPC ..... F04B 34/04; F04B 39/121; F04B 39/14; F04C 18/0215; F04C 23/008; F04C 28/28; F04C 2240/40; F04C 2230/603
USPC ..... 417/410.5; 418/55.2–55.5
See application file for complete search history.

(56) References Cited

U.S. PATENT DOCUMENTS 6,375,497 B1 * 4/2002 DiFlora ..... 439/566
2001/0012489 A1 * 8/2001 Harakawa et al. ..... 417/371
(Continued)

FOREIGN PATENT DOCUMENTS

JP 49-87508 U 7/1974
JP 08-109889 A 4/1996
(Continued)

OTHER PUBLICATIONS

Korean Office Action corresponding to Korean Patent Application No. 10-2011-7004968, dated Jan. 10, 2013.
(Continued)

*Primary Examiner* — Peter J Bertheaud
*Assistant Examiner* — Dominick L Plakkoottam
(74) *Attorney, Agent, or Firm* — Sughrue Mion, PLLC

(57) ABSTRACT

An electric compressor is provided with a hermetic terminal wherein the number of components and the number of steps and amount of time required for assembling the hermetic terminal and for machining the components are reduced, to thereby improve production efficiency. The hermetic terminal (41) is located in a through hole (2*c*) provided to a motor housing (2). A terminal main body (42) of the hermetic terminal (41) is provided with a flange portion (42*b*) located inside the motor housing (2) to prevent the hermetic terminal (41) from falling off to outside through the through hole (2*c*). Moreover, movement of the hermetic terminal (41) to an inner side of the motor housing (2) is restricted by a shaft supporting member (21) which faces thereto through a cluster block (44) interposed therebetween.

7 Claims, 14 Drawing Sheets

(51) Int. Cl.

| | |
|---|---|
| ***F04B 35/04*** | (2006.01) |
| ***F04B 39/12*** | (2006.01) |
| ***F04C 18/02*** | (2006.01) |
| ***F04C 23/00*** | (2006.01) |
| ***F04C 28/28*** | (2006.01) |

(52) U.S. Cl.

CPC ..... *F04C 18/0215* (2013.01); *F04C 23/008* (2013.01); *F04C 28/28* (2013.01); *F04C 2230/603* (2013.01); *F04C 2240/40* (2013.01); *F04C 2240/803* (2013.01); *F04C 2240/805* (2013.01); *F04C 2240/808* (2013.01)

USPC ..... 417/410.5; 418/55.2

(56) References Cited

U.S. PATENT DOCUMENTS

| | | | | |
|---|---|---|---|---|
| 2002/0029469 | A1* | 3/2002 | Bunch et al. | 29/857 |
| 2005/0111994 | A1* | 5/2005 | Kimura et al. | 417/313 |
| 2007/0004263 | A1* | 1/2007 | Berning | 439/345 |
| 2008/0138226 | A1* | 6/2008 | Koitabashi et al. | 418/55.1 |
| 2009/0304536 | A1* | 12/2009 | Egawa et al. | 417/423.14 |

FOREIGN PATENT DOCUMENTS

| | | | |
|---|---|---|---|
| JP | 11-146599 | A | 5/1999 |
| JP | 2004-003516 | A | 1/2004 |
| JP | 2005-130549 | A | 5/2005 |
| JP | 2005-220794 | A | 8/2005 |
| JP | 2006-217739 | A | 8/2006 |
| JP | 2006-291926 | A | 10/2006 |
| JP | 2007-100568 | A | 4/2007 |
| JP | 2007-128756 | A | 5/2007 |
| JP | 2008-147517 | A | 6/2008 |
| JP | 2008-148451 | A | 6/2008 |
| KR | 10-0840464 | | 6/2008 |
| WO | 2006/109511 | A1 | 10/2006 |

OTHER PUBLICATIONS

Communication from Japanese Patent Office dated Apr. 9, 2012 in counterpart Japanese Application No. 2008-223694.

* cited by examiner

ELECTRIC COMPRESSOR

CROSS REFERENCE TO RELATED APPLICATIONS

This application is a National Stage of International Application No. PCT/JP2009/061010 filed on Jun. 17, 2009, which claims priority from Japanese Patent Application No. 2008-223694, filed on Sep. 1, 2008, the contents of all of which are incorporated herein by reference in their entirety.

TECHNICAL FIELD

The present invention relates to an electric compressor, and in particular, to the retaining structure of a hermetic terminal.

BACKGROUND ART

In an electric compressor driven by an electric motor included therein, a hermetic terminal is used as a member for supplying electric power from outside of a housing to the electric motor and for maintaining airtightness in the housing. For example, Patent Document 1 describes an electric compressor which comprises a housing, and the hermetic terminal is assembled into an opening passing through the housing. The opening includes a large-diameter portion located at the side closer to the outside of the housing and a small-diameter portion located at the side closer to the inside of the housing. The hermetic terminal is locked to a shoulder portion corresponding to a boundary between the large-diameter portion and the small-diameter portion. An O-ring for maintaining airtightness in the housing is provided between the shoulder portion and the hermetic terminal, and the hermetic terminal is fixed by installing two circlips with the O-ring in the compressed state.

PRIOR ART DOCUMENT

Patent Document

Patent Document 1: JP 2007-128756 A

SUMMARY OF THE INVENTION

Problems to be Solved by the Invention

In the electric compressor described in Patent Document 1, however, the operation of installing the two circlips, while retaining the hermetic terminal with the O-ring in the compressed state, is required at the time of assembly of the hermetic terminal. Further, because the circlips cannot be installed if the two sides of the circlips are inverted, a confirmation operation and a correction operation for the orientation of the circlips are required. Furthermore, at the time of production of the housing, machining for forming grooves for the circlips on an inner circumferential surface of the opening is also required. That is to say, the electric compressor described in Patent Document 1 has a problem in that it is difficult to improve production efficiency because many steps and much time are required for assembling the hermetic terminal and machining components. Further, besides the electric compressor in which the hermetic terminal is installed to the housing of the electric compressor by using the circlips as in the case of the electric compressor described in Patent Document 1, there exists an electric compressor in which the housing and the hermetic terminal are fixed with bolts. Even in this case, at the time of assembly of the hermetic terminal, a fixing operation with the bolts is required. Moreover, it is necessary to provide bolt-through holes to the housing and the hermetic terminal for the fixation with the bolts. Specifically, even in the case where the hermetic terminal is fixed to the housing of the electric compressor with bolts, a large number of steps are required for assembling the hermetic terminal and for machining the components as in the case of the electric compressor described in Patent Document 1. Therefore, there is a problem in that it is difficult to reduce production cost.

The present invention has been made to solve the problems described above, and has an object to provide an electric compressor which achieves a reduction in the number of components, and in the number of steps and the amount of time required for assembling a hermetic terminal and machining the components to provide improved production efficiency.

Means for Solving the Problems

An electric compressor according to the present invention comprises: a compression mechanism for compressing a refrigerant to discharge the compressed refrigerant; an electric motor including a drive shaft, for driving the compression mechanism through the drive shaft; a housing for accommodating the compression mechanism and the electric motor; and a hermetic terminal for supplying electric power from outside of the housing to the electric motor, wherein: the housing is provided with a through hole in which the hermetic terminal is located; a sealing device for maintaining airtightness in the housing is provided between the hermetic terminal and the housing; the hermetic terminal includes a pass preventing portion located inside the housing; the pass preventing portion prevents the hermetic terminal from falling outside through the through hole; and movement of the hermetic terminal from an outer side of the housing to an inner side of the housing is restricted by a movement restricting member located so as to face the hermetic terminal.

Further, an electric compressor according to the present invention comprises: a compression mechanism for compressing a refrigerant to discharge the compressed refrigerant; an electric motor for driving the compression mechanism; a housing for accommodating the compression mechanism and the electric motor; and a hermetic terminal for supplying electric power from outside of the housing to the electric motor while maintaining airtightness in the housing, wherein: the housing is provided with a through hole having a large-diameter portion being open to inside of the housing, in which the hermetic terminal is located, and having a small-diameter portion passing through from the large-diameter portion to outside of the housing; the hermetic terminal is prevented from falling outside of the housing through the through hole by a stepped portion between the large-diameter portion and the small-diameter portion of the through hole; and movement of the hermetic terminal from an outer side of the housing to an inner side of the housing is restricted by a movement restricting member located so as to face the hermetic terminal.

According to the present invention, an electric compressor is provided which achieves a reduction in the number of components, and in the number of steps and amount of time required for assembling a hermetic terminal and machining the components to provide improved production efficiency.

BEST MODE FOR CARRYING OUT THE INVENTION

Hereinafter, embodiments of the present invention are described based on the accompanying drawings.

Embodiment 1

Figure 1:
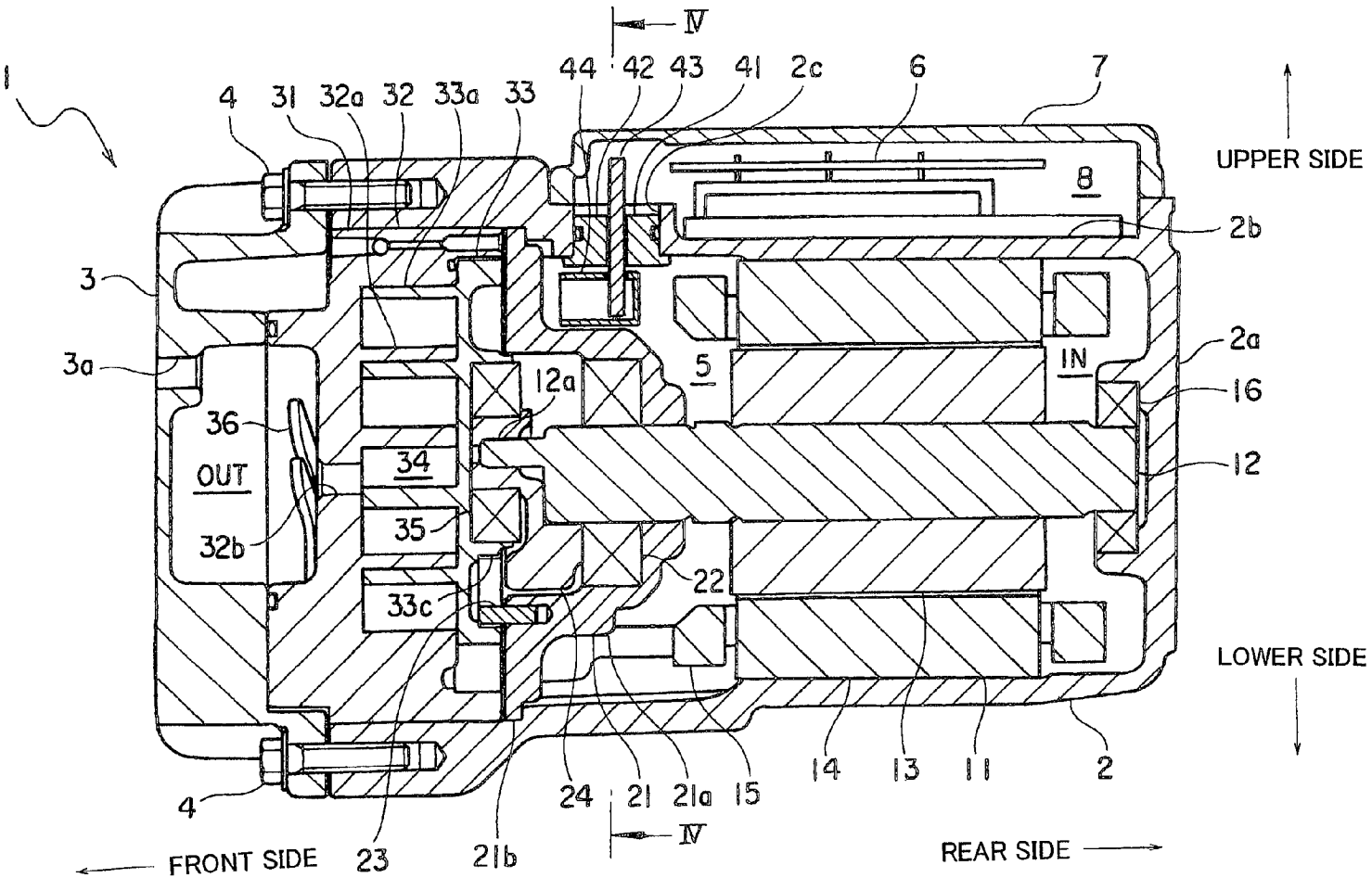
FIG. 1 is a sectional side view illustrating an electric compressor according to Embodiment 1 of the present invention.

FIG. 1 illustrates an electric compressor 1 according to Embodiment 1. Front/rear sides and upper/lower sides of the electric compressor 1 are defined by arrows illustrated in FIG. 1.

The electric compressor 1 includes a motor housing 2. A front housing 3 is provided to a front end of the motor housing 2. The motor housing 2 and the front housing 3 are connected to each other by a plurality of bolts 4. Here, the motor housing 2 and the front housing 3 constitute a housing in the electric compressor 1. The motor housing 2 is an approximately cylindrical member having a bottom portion 2*a* on the rear side. Inside the motor housing 2, a space 5 which is open to a front side is formed. In the space 5, an electric motor 11, a compression mechanism 31 driven by the electric motor 11, and a shaft supporting member 21 located between the electric motor 11 and the compression mechanism 31 are accommodated.

In a rear part of the electric compressor 1, an intake-side space IN is formed between the bottom portion 2*a* of the motor housing 2 and the electric motor 11. The intake-side space IN and an external refrigerant circuit are brought into communication with each other through an intake port (not shown) provided to the motor housing 2. On the other hand, in a front part of the electric compressor 1, a discharge-side space OUT is formed by the front housing 3 and a front end of the compression mechanism 31. The discharge-side space OUT and the external refrigerant circuit are brought into communication with each other through a discharge port 3*a* provided to the front housing 3.

On an area of an outer circumferential surface of the motor housing 2, which is located on the upper side, a placement portion 2*b* which is concaved in a flattened fashion is formed. On the placement portion 2*b*, there is provided an inverter 6 for converting DC power supplied from the outside of the electric compressor 1 into three-phase AC power so as to supply the three-phase AC power to the electric motor 11 and for controlling the rotational speed of the electric motor 11. A cover 7 for covering the inverter 6 is connected to the top of the motor housing 2. Inside the cover 7, an inverter housing chamber 8 which is a space isolated from the space 5 inside the motor housing 2 is formed.

Inside the inverter housing chamber 8, a through hole 2*c* passing from the outer side of the motor housing 2 to the inner side is provided on a front side of the inverter 6, and a hermetic terminal 41 is provided in the through hole 2*c*. The hermetic terminal 41 includes conductive members 43 made of a metal and electrically connects the inverter 6 provided on the outer side of the motor housing 2 and the electric motor 11 provided on the inner side of the motor housing 2 through an intermediation of the conductive members 43. The structure around the hermetic terminal 41 is described later.

The electric motor 11 includes a rotor 13 having a hollow cylindrical shape and a stator 14 provided on an outer circumferential portion of the rotor 13, around which a coil 15 is wound. The electric motor 11 also includes a drive shaft 12 passing through an inner circumferential portion of the rotor 13, and the rotor 13 and the drive shaft 12 are fixed so as to rotate integrally. A rear end of the drive shaft 12 is rotatably supported by a bearing 16 fitted into the bottom portion 2*a* of the motor housing 2. A front end of the drive shaft 12 passes through the shaft supporting member 21 and is rotatably supported by a bearing 22 fitted into the shaft supporting member 21. The shaft supporting member 21 is a hollow member having a hexagonal portion 21*a* having an outer circumferential surface formed in a regular hexagonal shape (see FIG. 4) and a cylindrical portion 21*b*. The cylindrical portion 21*b* is fitted into the motor housing 2. Here, the electric motor 11 is a three-phase synchronous motor driven by the three-phase AC power supplied from the inverter 6 provided on the outer side of the motor housing 2.

Figure 2:
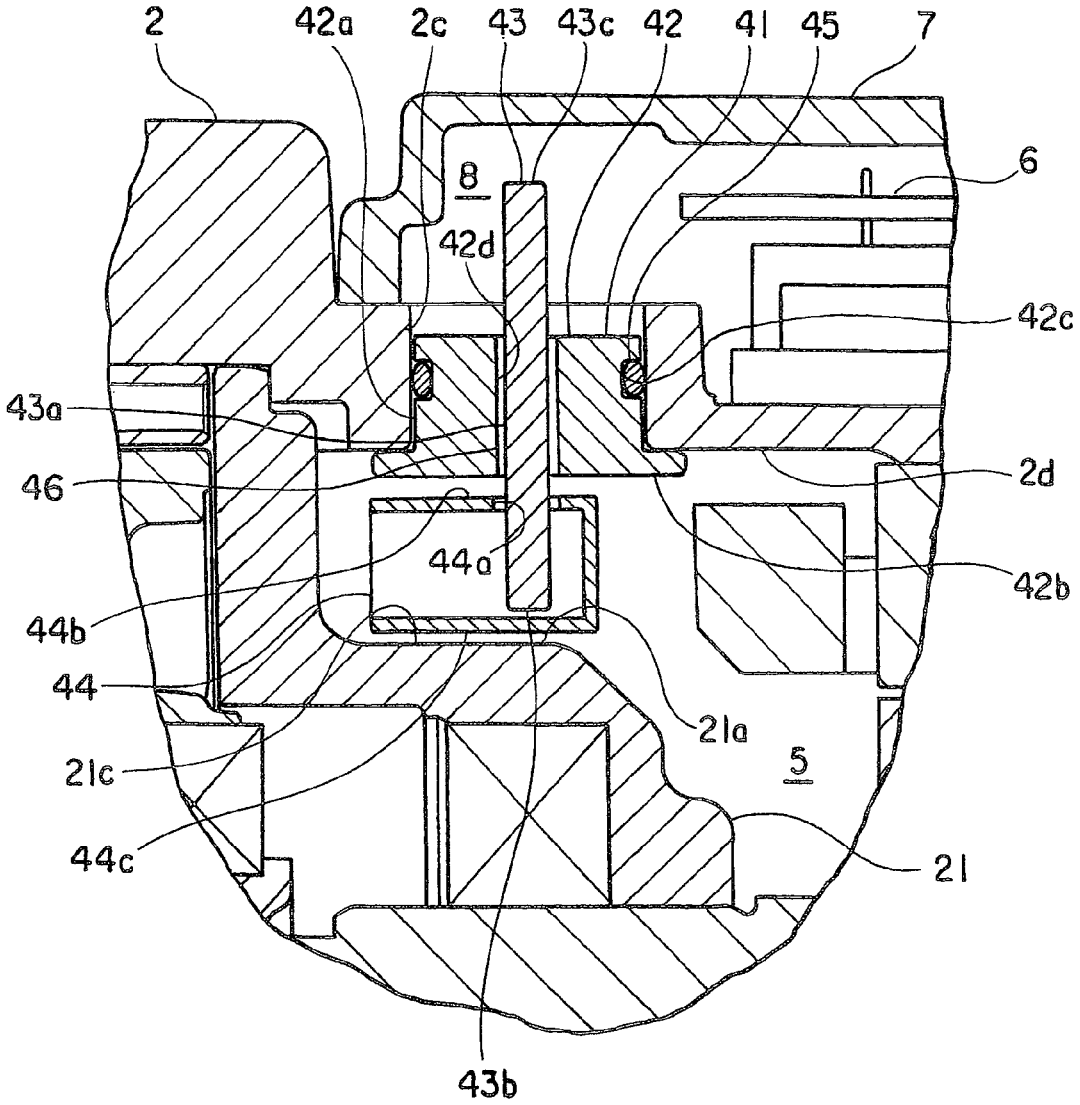
FIG. 2 is a partially enlarged sectional view illustrating the structure around a hermetic terminal in the electric compressor according to Embodiment 1 of the present invention.
Figure 3:
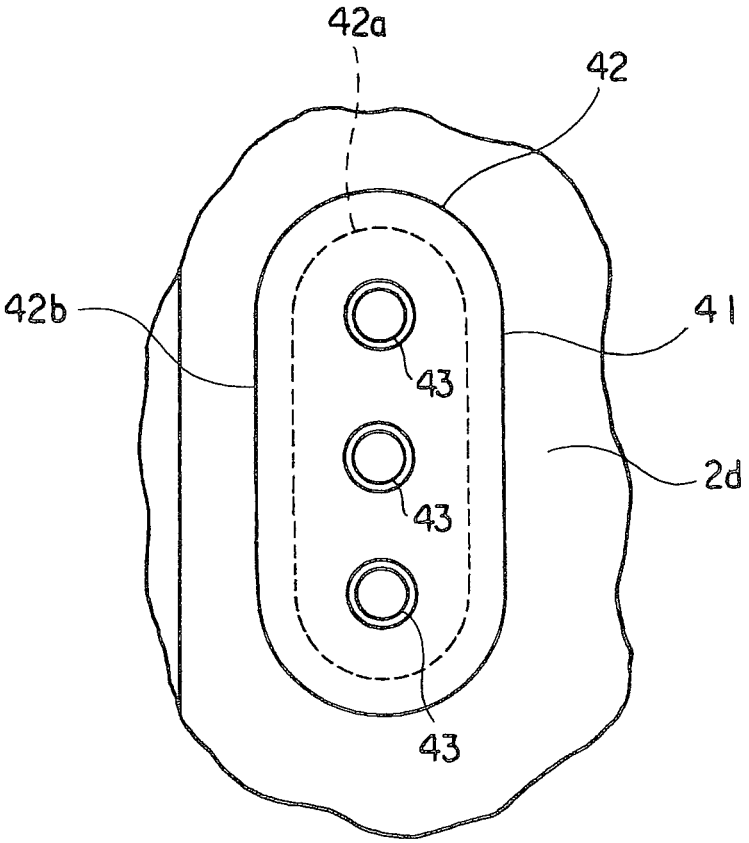
FIG. 3 is a schematic view illustrating the structure around the hermetic terminal in the electric compressor according to Embodiment 1 of the present invention.
Figure 4:
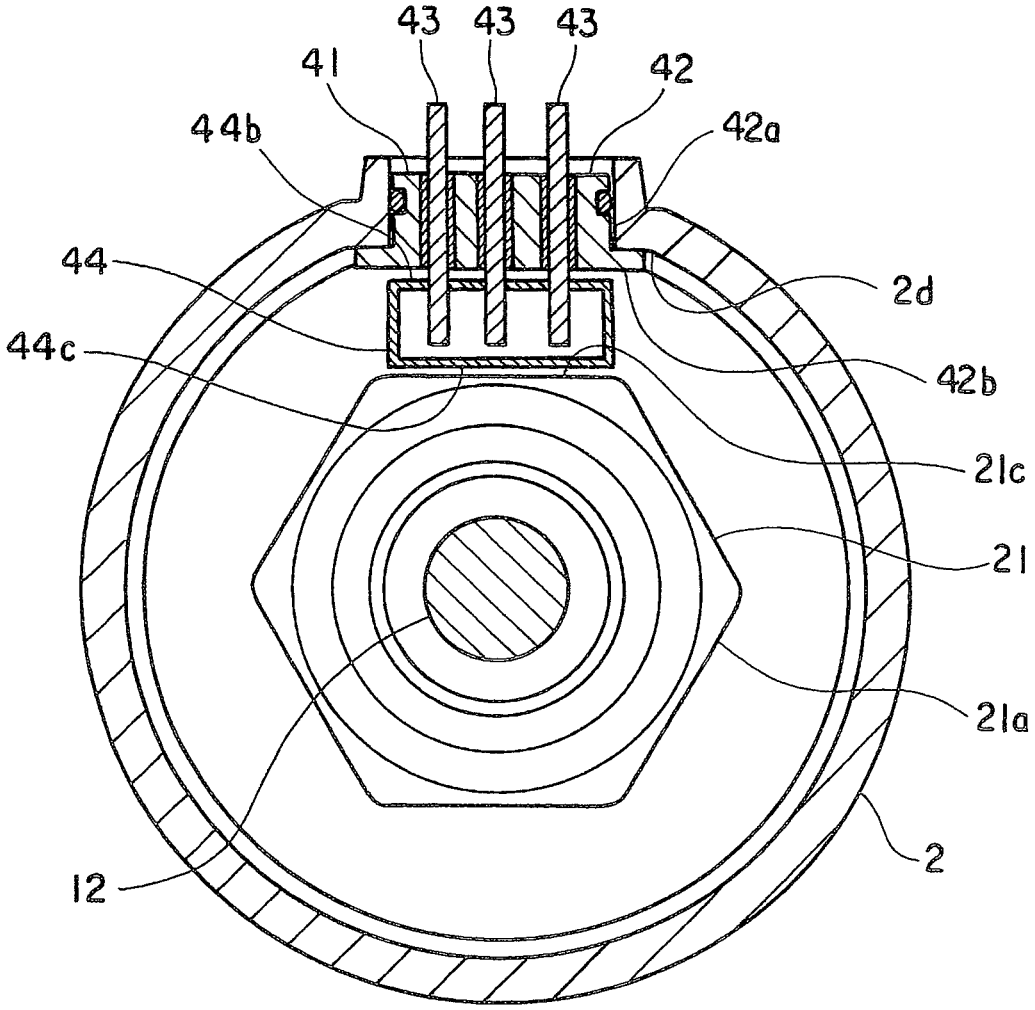
FIG. 4 is a sectional plan view schematically illustrating a cross section taken along the line IV-IV of FIG. 1.

Next, the structure around the hermetic terminal 41 is described in detail with FIGS. 2 to 4.

As illustrated in FIG. 2, the hermetic terminal 41 includes a terminal main body 42 and the conductive members 43 respectively passing through holes 42*d* provided to the terminal main body 42. An insulating adhesive 46 is applied onto an area of an outer circumferential surface 43*a* of each of the conductive members 43, which is located inside the holes 42*d* of the terminal main body 42, so that the terminal main body 42 and the conductive members 43 are integrally fixed.

The terminal main body 42 has a side wall 42*a* and is inserted into the through hole 2*c* of the motor housing 2. In a lower part of the terminal main body 42, an end portion of the side wall 42*a* projects into the space 5 corresponding to the interior of the motor housing 2 and expands outward to form a flange portion 42*b* corresponding to a pass preventing portion. The flange portion 42*b* is formed so as to be larger than the through hole 2*c*, and thus the hermetic terminal 41 is prevented from passing to the outside through the through hole 2*c*. Specifically, the hermetic terminal 41 is prevented from passing to the outside through the through hole 2*c* by the contact between the inner circumferential surface 2*d* of the motor housing 2 and the flange portion 42*b* of the terminal main body 42.

A groove 42*c* is formed in an area of the side wall 42*a* of the terminal main body 42, which is located inside the through hole 2*c* of the motor housing 2, over an entire circumference. An O-ring 45 corresponding to a sealing device is provided in the groove 42*c*. The O-ring 45 is held between the through hole 2*c* of the motor housing 2 and the groove 42*c* of the terminal main body 42. As a result, the space 5 corresponding to the inner side of the motor housing 2 and the inverter housing chamber 8 corresponding to the outer side of the motor housing 2 are sealed to maintain airtightness in the space 5.

Here, the hermetic terminal 41 viewed from the inner side of the motor housing 2 is illustrated in FIG. 3. The hermetic terminal 41 includes the three conductive members 43. The conductive members 43 correspond to the three phases of the electric motor 11 respectively. The terminal main body 42 has a shape obtained by combining semi-circles to both short sides of a rectangle. The three conductive members 43 are arranged in one row on a straight line connecting the centers of the semi-circles at both ends of the terminal main body 42. The flange portion 42*b* of the terminal main body 42 is formed over the entire circumference of the terminal main body 42.

Returning to FIG. 2, a cluster block 44 for electrically connecting the electric motor 11 and the hermetic terminal 41 to each other is provided below the hermetic terminal 41. A lower end portion 43*b* of each of the conductive members 43 passes through a hole 44*a* provided through an upper end surface 44*b* of the cluster block 44 to extend into the cluster block 44 so as to be electrically connected to the electric motor 11 through a connection terminal and a lead wire (both not shown). On the other hand, an upper end portion 43*c* of each of the conductive members 43 extends into the inverter housing chamber 8 so as to be electrically connected to the inverter 6 through a lead wire (not shown). The hexagonal portion 21*a* of the shaft supporting member 21 is arranged so as to face the hermetic terminal 41 through the cluster block 44 interposed therebetween.

As illustrated in FIG. 4, the shaft supporting member 21 is arranged so that one flat surface 21*c* of the hexagonal portion 21*a* and a lower end surface 44*c* of the cluster block 44 face each other. Therefore, movement of the hermetic terminal 41 from the outer side of the motor housing 2 to the inner side is restricted by the shaft supporting member 21 through an intermediation of the cluster block 44. Specifically, in this embodiment, the shaft supporting member 21 forms a movement restricting member.

As described above, the hermetic terminal 41 is inserted from the inner side of the motor housing 2 to be located in the through hole 2*c*. In addition, the inner circumferential surface 2*d* of the motor housing 2 and the flange portion 42*b* of the terminal main body 42 are brought into contact with each other. As a result, the hermetic terminal 41 is prevented from passing to the outside through the through hole 2*c* of the motor housing 2. Moreover, the hermetic terminal 41 is not fixed with respect to the through hole 2*c*, and hence is movable in a vertical direction of FIG. 4. However, downward movement of the hermetic terminal 41 in FIG. 2 is restricted by the shaft supporting member 21 provided so as to face the hermetic terminal 41 through the cluster block 44 interposed therebetween. Therefore, the hermetic terminal 41 and the cluster block 44 are prevented from falling into the motor housing 2.

Returning to FIG. 1, the compression mechanism 31 is connected to a front end portion of the drive shaft 12 passing through the shaft supporting member 21. The compression mechanism 31 includes a fixed scroll 32 fixed to the motor housing 2 and an orbiting scroll 33 provided on a rear side of the fixed scroll 32. An eccentric portion 12*a* which is eccentric with respect to the shaft axis of the drive shaft 12 is provided to a front distal end portion of the drive shaft 12. The eccentric portion 12*a* and the orbiting scroll 33 are connected to each other through a bearing 35 which is fitted into a rear part of the orbiting scroll 33 and a bush 24. An end of a pin 23 is fitted into a front surface of the shaft supporting member 21. The other end of the pin 23 is inserted into a concave portion 33*c* formed in the rear part of the orbiting scroll 33 so as to prevent the self-rotation of the orbiting scroll 33.

The fixed scroll 32 includes a fixed lap 32*a* projecting backward, whereas the orbiting scroll 33 includes an orbiting lap 33*a* projecting forward so as to face the fixed lap 32*a* of the fixed scroll 32. A compression chamber 34, which is a space partitioned by the fixed lap 32*a* and the orbiting lap 33*a*, is formed between the fixed scroll 32 and the orbiting scroll 33. In the center of the fixed scroll, a discharge port 32*b* and a discharge valve 36 are provided. The compression chamber 34 and the discharge-side space OUT are brought into communication with each other through the discharge port 32*b* and the discharge valve 36. The intake-side space IN and the compression chamber 34 are brought into communication with each other through an intake passage (not shown).

When electric power is supplied to the coil 15 of the electric motor 11 in the electric compressor 1 configured as described above, the rotor 13 and the drive shaft 12 rotate integrally. With the rotation of the drive shaft 12, the orbiting scroll 33 orbits. When the orbiting scroll 33 orbits, the volume of the compression chamber 34 formed between the fixed scroll 32 and the orbiting scroll 33 changes. As a result, refrigerant present in the external refrigerant circuit is sucked from the intake-side space IN into the compression chamber 34. The refrigerant, which is compressed in the compression chamber 34, is discharged to the discharge-side space OUT through the discharge port 32*b* and the discharge valve 36 formed in the fixed scroll 32 to be then discharged to the external refrigerant circuit through the discharge port 3*a*. The discharged refrigerant circulates through the external refrigerant circuit to be sucked into the intake-side space IN again.

Next, a method of assembling the hermetic terminal 41 of the electric compressor 1 according to Embodiment 1 of the present invention is described.

First, the electric motor 11 is inserted into the motor housing 2. Next, the cluster block 44 is mounted to the hermetic terminal 41. Then, the hermetic terminal 41 is inserted into the through hole 2*c* of the motor housing 2. After the hermetic terminal 41 is inserted into the through hole 2*c*, the shaft supporting member 21 is inserted into the motor housing 2.

As described above, the flange portion 42*b*, which is located inside the motor housing 2 and prevents the hermetic terminal 41 from passing to the outside through the through hole 2*c*, is provided to the hermetic terminal 41 provided in the through hole 2*c* of the motor housing 2. Therefore, even when internal pressure of the motor housing 2 is increased during the operation of the electric compressor 1, the hermetic terminal 41 does not fall from the motor housing 2 to the outer side. On the other hand, the shaft supporting member 21 accommodated in the motor housing 2 is provided so as to face the hermetic terminal 41, to thereby restrict the movement of the hermetic terminal 41 from the outer side of the motor housing 2 to the inner side. Therefore, the hermetic terminal 41 is also prevented from falling to the inner side of the motor housing 2. Specifically, at the time of assembly of the hermetic terminal 41, by simply locating the hermetic terminal 41 in the through hole 2*c* from the inner side of the motor housing 2 and then locating the shaft supporting member 21 in the motor housing 2, the hermetic terminal 41 is retained. Moreover, the hermetic terminal 41 is retained even without using a retainer such as a circlip. Therefore, it is not necessary to form a groove or the like for the retainer on the motor housing 2. Therefore, in the electric compressor 1, the number of components is reduced, while the number of steps and the amount of time required for assembling the hermetic terminal and machining the components are reduced. As a result, production efficiency can be improved.

Moreover, the shaft supporting member 21 is arranged so as to face the hermetic terminal 41 through the cluster block 44 interposed therebetween. Therefore, the hermetic terminal 41 can be prevented from falling to the inner side of the motor housing 2 and the cluster block 44 can be prevented from falling from the hermetic terminal 41 by the same configuration.

Embodiment 2

Next, an electric compressor according to Embodiment 2 of the present invention is described. In the following embodiments, the same reference symbols as those of FIGS. 1 to 4 denote the same or similar components. Therefore, the detailed description thereof is herein omitted.

Figure 5:
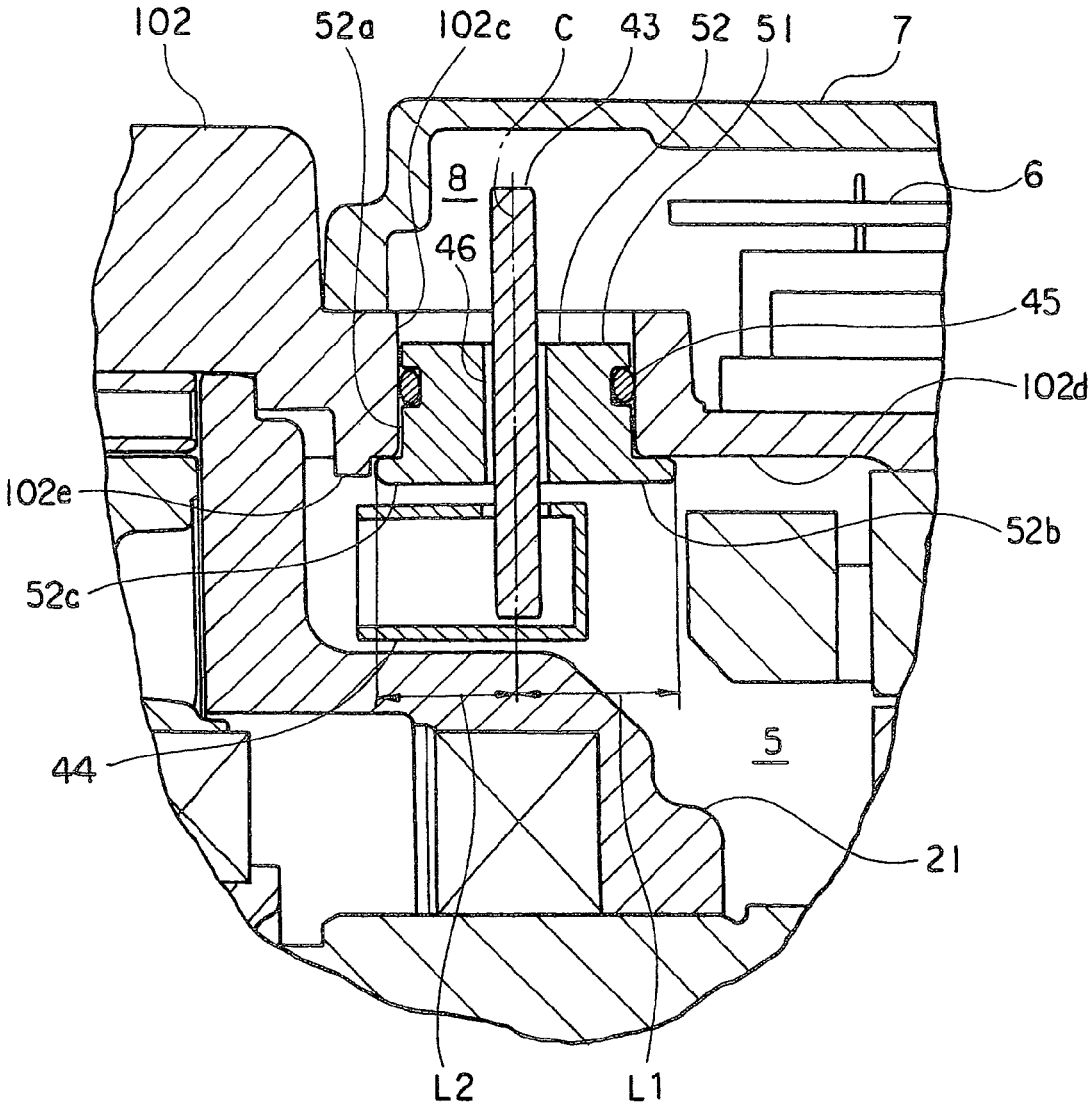
FIG. 5 is a partially enlarged sectional view illustrating the structure around a hermetic terminal in an electric compressor according to Embodiment 2 of the present invention.

As illustrated in FIG. 5, a motor housing 102 is provided with a through hole 102*c* for bringing the space 5 on an inner side thereof and the inverter housing chamber 8 on an outer side into communication with each other. In the through hole 102*c*, a hermetic terminal 51 is provided. The hermetic terminal 51 includes a terminal main body 52. The hermetic terminal 51 is inserted into the through hole 102*c* so that a side wall 52*a* of the terminal main body 52 is located inside the through hole 102*c*. In a lower part of the terminal main body 52, a flange portion 52*b* similar to the flange portion 42*b* of Embodiment 1 is formed at an end portion of the side wall 52*a*.

Figure 6:
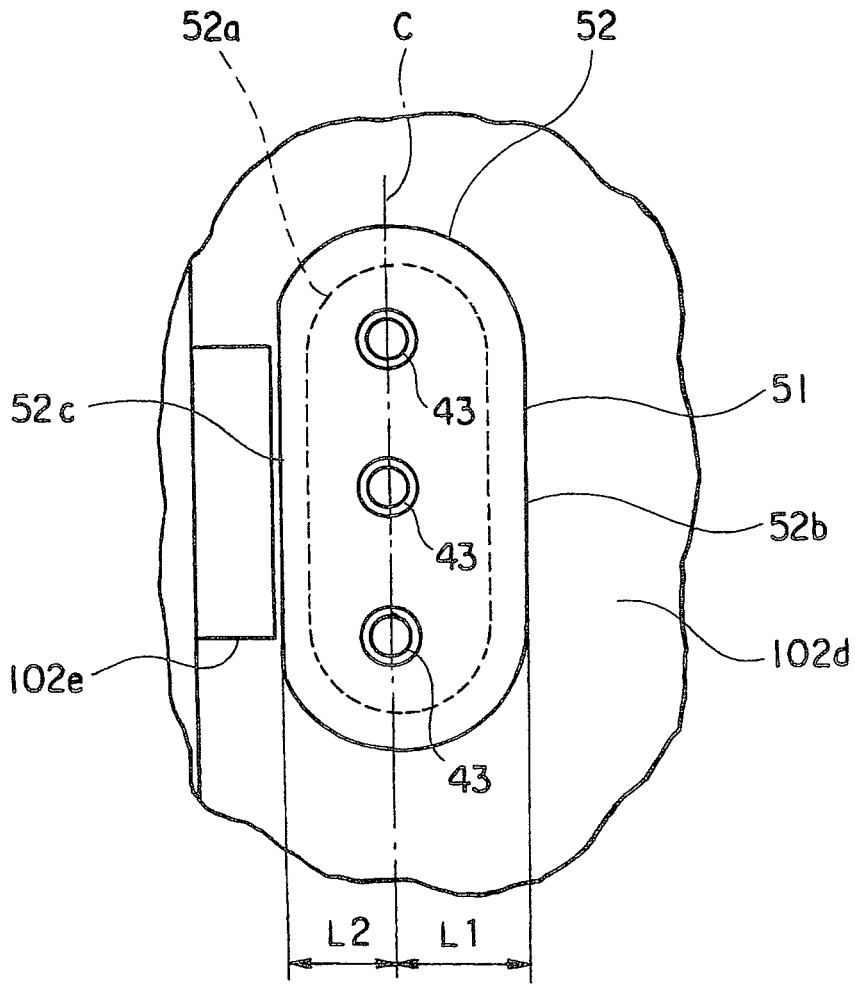
FIG. 6 is a schematic view illustrating the structure around the hermetic terminal in the electric compressor according to Embodiment 2.

On a front part of the terminal main body 52, a part of the flange portion 52*b* is cut away to form a flange portion 52*c*. The flange portion 52*b* and the flange portion 52*c* have different amounts of outward projection to form an asymmetrical shape. Specifically, the flange portion 52*b* and the flange portion 52*c* are formed so that a length from a center line C of the terminal main body 52 to a distal end portion of the flange portion 52*b* becomes L1 and a length from the center line C to a distal end portion of the flange portion 52*c* becomes L2 which is shorter than the length L1. On the other hand, a projecting portion 102*e* projecting to the radially inner side of the housing 102 is formed on an area of an inner circumferential surface 102*d* of the motor housing 102, which is located on a front side of the hermetic terminal 51. As illustrated in FIG. 6, the projecting portion 102*e* faces the flange portion 52*c* of the hermetic terminal 51 so that the flange portion 52*c* and the projecting portion 102*e* have a correspondence relation. Specifically, if the hermetic terminal 51 is assembled so that the flange portion 52*b* is located on the front side, the flange portion 52*b* and the projecting portion 102*e* are configured to be brought into contact with each other so that the hermetic terminal 51 is spaced from the inner circumferential surface 102*d*. In this case, the flange portion 52*c* formed on the terminal main body 52 of the hermetic terminal 51 forms a mis-assembly preventing portion. The remaining structure is the same as that of Embodiment 1.

As described above, the projecting portion 102*e* is provided on the inner side of the motor housing 102, while the flange portion 52*c* is formed so that the asymmetrical shape is formed with the flange portion 52*b* having a different amount of projection. In addition, the flange portion 52*c* is arranged so as to have a correspondent relation with the projecting portion 102*e*. Therefore, the hermetic terminal 51 can be easily prevented from being assembled in an erroneous orientation. Thus, the production efficiency of the electric compressor can be further improved.

Embodiment 3

Next, an electric compressor according to Embodiment 3 of the present invention is described.

Figure 7:
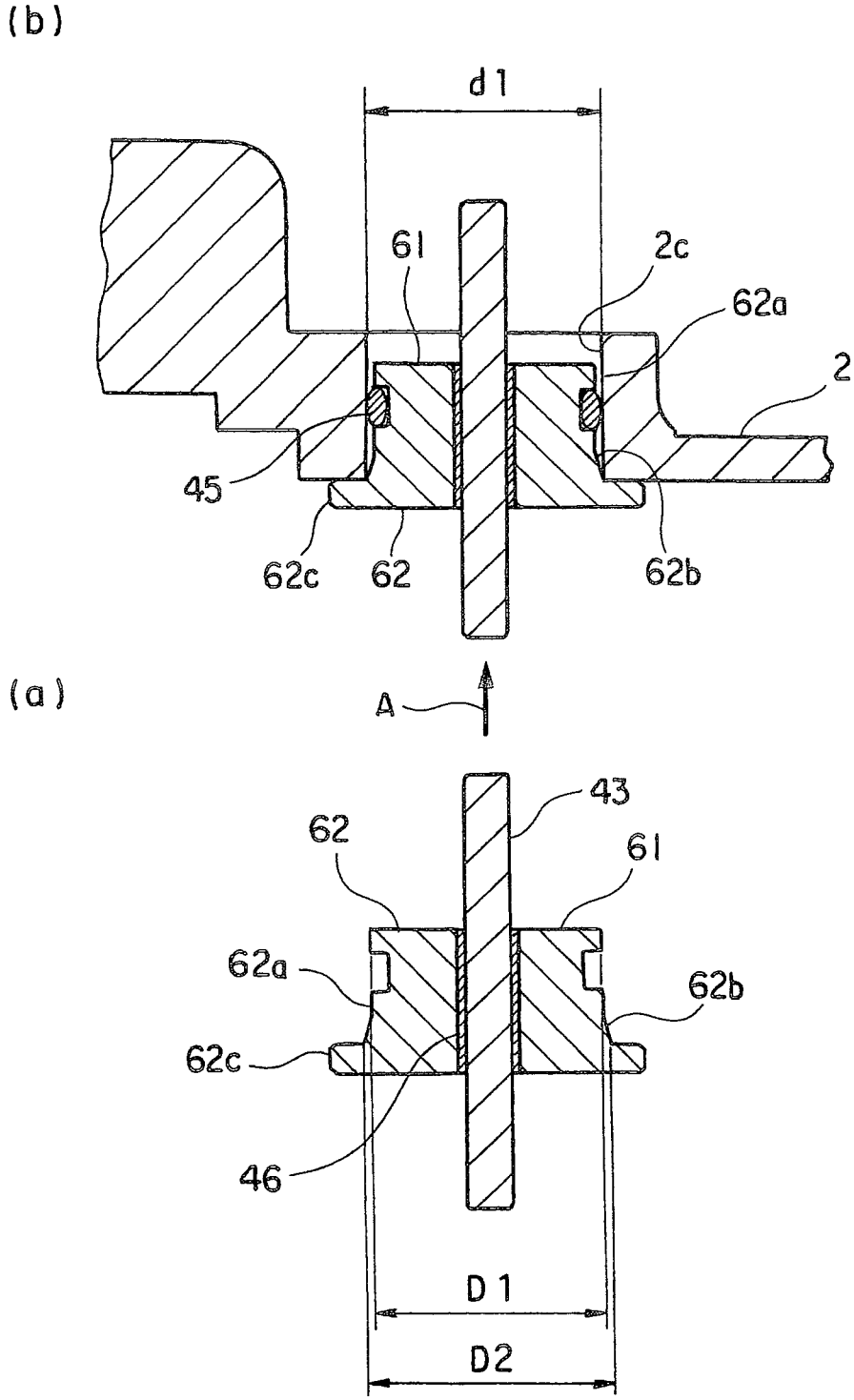
FIGS. 7(*a*) and 7(*b*) are Schematic views, each illustrating the structure around a hermetic terminal in an electric compressor according to Embodiment 3 of the present invention.

As illustrated in FIG. 7(*a*), a side wall 62*a* of a terminal main body 62 of a hermetic terminal 61, which has a length D1 in a fore-and-aft direction, starts expanding in the middle to a flange portion 62*c* in a tapered manner to form a tapered portion 62*b* having a length D2 at a lower end portion. The length D2 of the lower end portion of the tapered portion 62*b* is larger than a length dl of the through hole 2*c* of the motor housing 2 (see FIG. 7(*b*)). The remaining structure is the same as that of Embodiment 1.

As described above, the tapered portion 62*b* to be fitted into the through hole 2*c* of the motor housing 2 is provided to the terminal main body 62 of the hermetic terminal 61. Therefore, as the terminal main body 61 is inserted into the through hole 2*c* as illustrated in FIG. 7(*b*), the hermetic terminal 61 is pressed into the through hole 2*c*. Finally, the tapered portion 62*b* is fitted into the through hole 2*c* to fix the hermetic terminal 61 with respect to the through hole 2*c*. Therefore, the hermetic terminal 61 is prevented from vibrating. Thus, poor contact due to the vibration of the hermetic terminal 61 or the like can be prevented to improve the reliability of the electric compressor.

Embodiment 4

Next, an electric compressor according to Embodiment 4 of the present invention is described.

Figure 8:
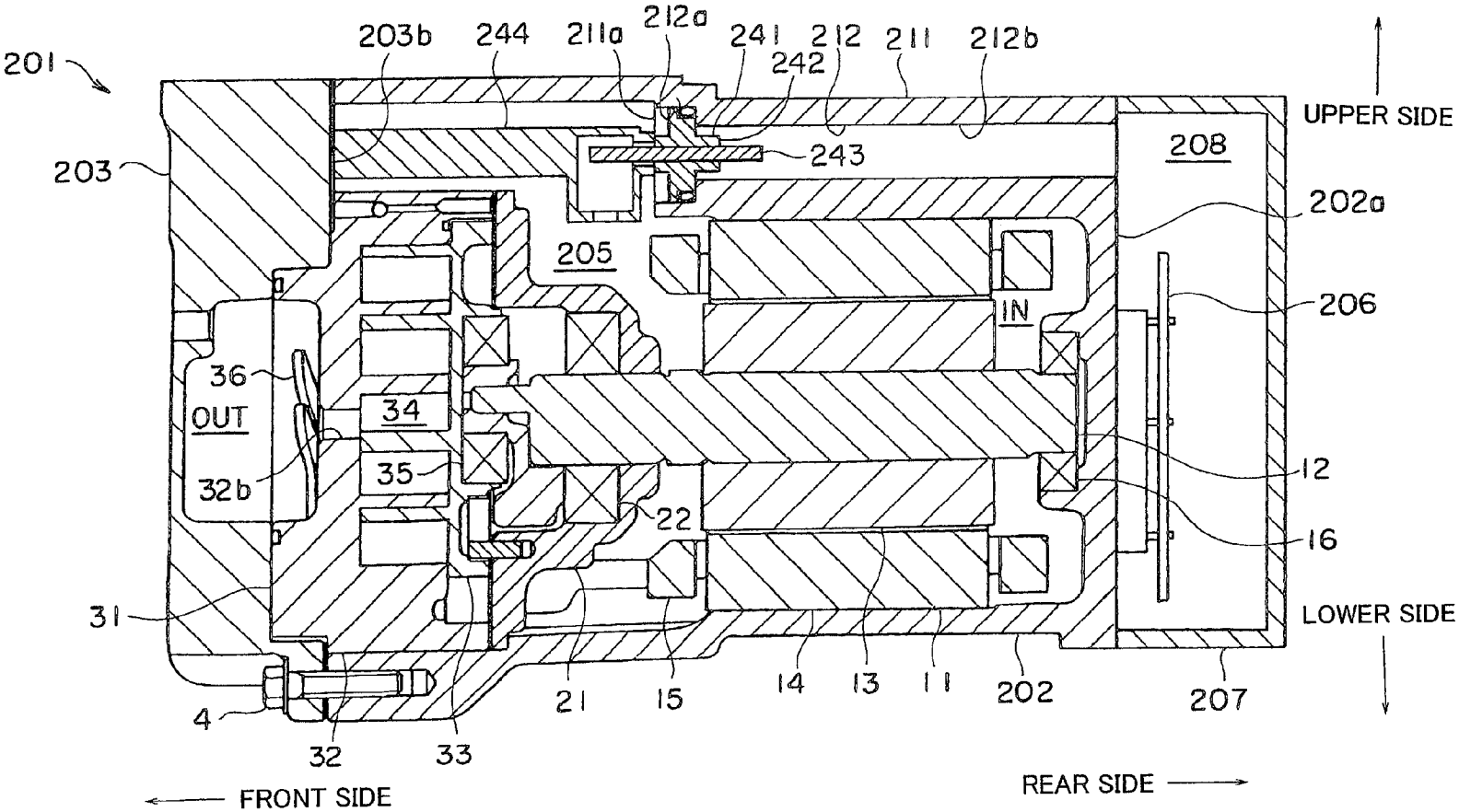
FIG. 8 is a sectional side view illustrating an electric compressor according to Embodiment 4 of the present invention.

FIG. 8 illustrates an electric compressor 201 according to Embodiment 4. The electric compressor 201 includes a motor housing 202 and a front housing 203 connected to a front end portion of the motor housing 202 with a plurality of bolts 4. The motor housing 202 is an approximately cylindrical member having a bottom portion 202*a* at a rear end. Inside the motor housing 202, a space 205 which is open to a front side is formed. In the space 205, the electric motor 11, the shaft supporting member 21, and the compression mechanism 31 are accommodated as in the case of the electric compressor 1 of Embodiment 1.

On the other hand, an inverter housing 207 is connected to the bottom portion 202*a* which is the rear end portion of the motor housing 202 with a plurality of bolts (not shown). Inside the inverter housing 207, an inverter housing chamber 208 corresponding to a space which is partitioned by the bottom portion 202*a* and isolated from the space 205 inside the motor housing 202 is formed. Inside the inverter housing chamber 208, an inverter 206 for supplying three-phase electric power to the electric motor 11 and for controlling the rotational speed of the electric motor 11 is provided in a fixed state onto the bottom portion 202*a*. Specifically, the electric compressor 201 has structure in which the compression mechanism 31, the electric motor 11, and the inverter 206 are sequentially arranged in series along an axial direction thereof.

Figure 9:
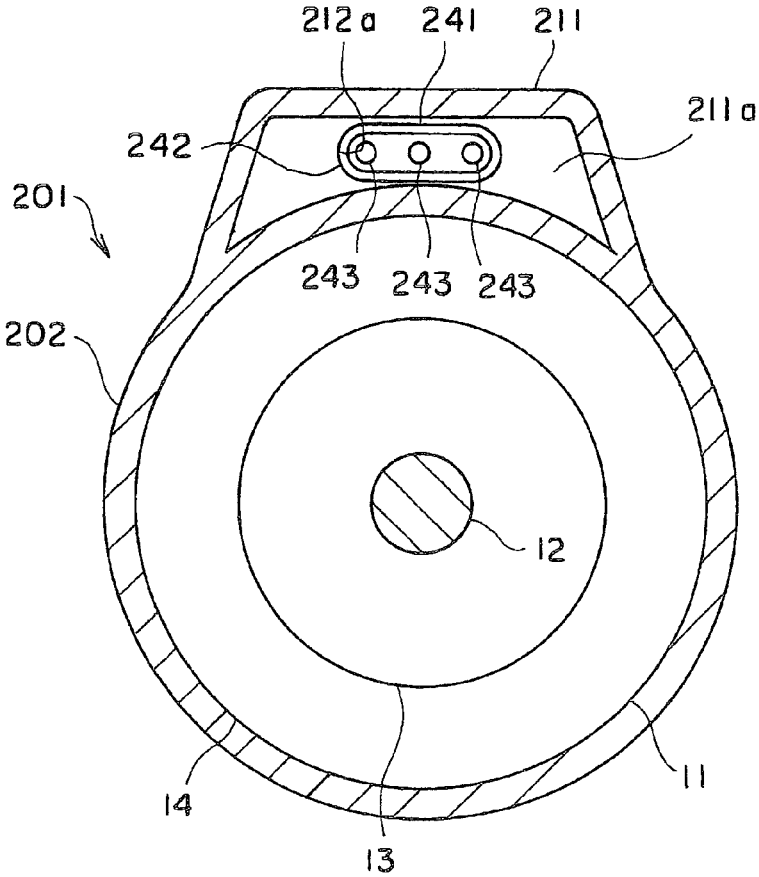
FIG. 9 is a schematic view illustrating the structure around the hermetic terminal of the electric compressor according to Embodiment 4.

A part of an upper part of the motor housing 202 projects radially outward to form a passage forming portion 211 (see FIG. 9) having a partition wall surface 211*a* vertical to the axial direction of the electric compressor 201 on an inner side. The passage forming portion 211 is provided with a through hole 212 which extends backward from the partition wall surface 211*a* along the axial direction of the electric compressor 201 and passes from the space 205 on the inner side of the motor housing 202 to the inverter housing chamber 208 on the outer side. In the through hole 212, a hermetic terminal 241 for electrically connecting the electric motor 11 and the inverter 206 to each other is provided.

Figure 10:
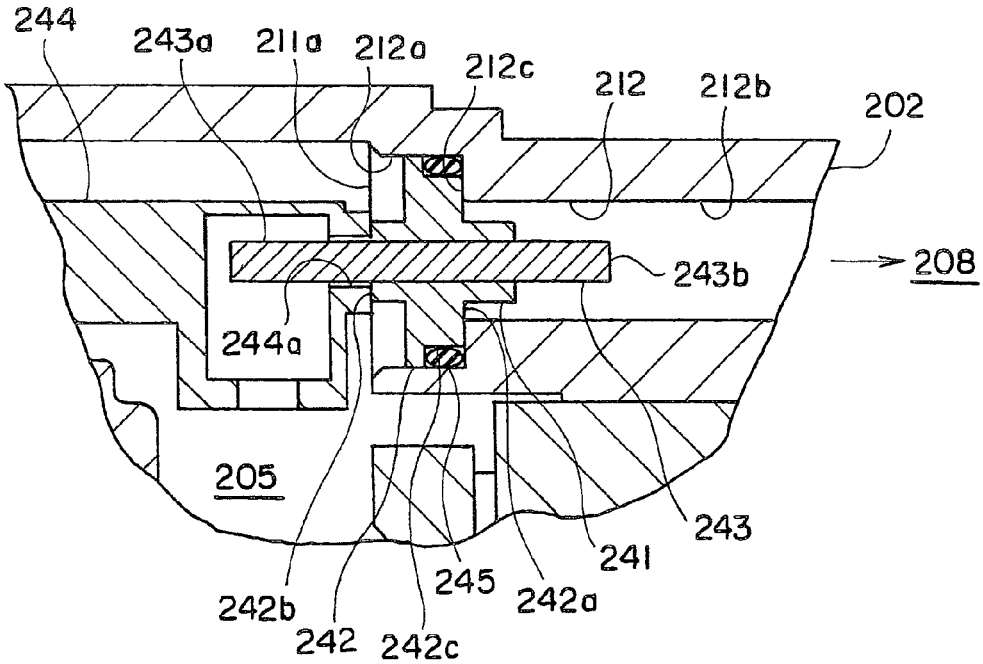
FIG. 10 is a partially enlarged sectional view illustrating the structure around the hermetic terminal of the electric compressor according to Embodiment 4.

As illustrated in FIG. 10, the through hole 212 has a large-diameter portion 212*a* provided on a side closer to the partition wall surface 211*a* so as to be open to the space 205 and a small-diameter portion 212*b* passing through from the large-diameter portion 212*a* to the inverter housing chamber 208. The hermetic terminal 241 is provided inside the large-diameter portion 212*a*. The hermetic terminal 241 includes a terminal main body 242 and conductive members 243 passing through the terminal main body 242, which are integrally fixed by an insulating adhesive (not shown). The hermetic terminal 241 includes three conductive members 243 (see FIG. 9) as in the case of the hermetic terminal 41 of Embodiment 1. The conductive members 243 correspond to the three phases of the electric motor 11 respectively.

A top end surface 242*a* of the terminal main body 242 is locked to a stepped portion 212*c* between the large-diameter portion 212*a* and the small-diameter portion 212*b* of the through hole 212. As a result, the hermetic terminal 241 is prevented from passing through the through hole 212 to move into the inverter housing chamber 208. Moreover, a shoulder portion 242*c* for holding an O-ring 245 between an outer circumferential surface of the terminal main body 242 and an inner circumferential surface of the large-diameter portion 212*a* is formed on the outer circumferential surface of the terminal main body 242. The O-ring 245 seals the space 205 and the inverter housing chamber 208. As a result, airtightness in the space 205 with respect to the inverter housing chamber 208 is maintained.

Returning to FIG. 8, a cluster block 244 for electrically connecting the electric motor 11 and the hermetic terminal 241 to each other is provided on a front side of the hermetic terminal 241. The cluster block 244 is provided so as to extend between a bottom end surface 242*b* (see FIG. 10) of the terminal main body 242 and a rear end surface 203*b* of the front housing 203. Small clearances, which do not allow the hermetic terminal 241 to pass through the large-diameter portion 212*a* of the through hole 212 to fall into the space 5, are formed between the front housing 203 and the cluster block 244 and between the terminal main body 242 and the cluster block 244.

As described above, in the electric compressor 201, a part of the rear end surface 203*b* of the front housing 203 faces the hermetic terminal 241 provided inside the large-diameter portion 212*a* of the through hole 212 through the cluster block 244 interposed therebetween. Specifically, the front housing 203 restricts movement of the hermetic terminal 241 from the side of the inverter housing chamber 208 which is the outer side of the motor housing 202 to the side of the space 205 which is the inner side. In this case, the front housing 203 forms a movement restricting member in the electric compressor 201.

As illustrated in FIG. 10, a front end portion 243*a* of each of the conductive members 243 of the hermetic terminal 241 passes through a hole 244*a* provided to a rear end of the cluster block 244. The electric motor 11 is electrically connected to the conductive members 243 extending into the cluster block 244 through a connection terminal and a lead wire (both not shown). On the other hand, a rear end 243*b* of each of the conductive members 243 extends into the small-diameter portion 212*b* of the through hole 212 and is connected to one end of a lead wire (not shown). The other end of the lead wire extends from the inside of the small-diameter portion 212*b* into the inverter housing chamber 208 so as to be connected to the inverter 206. The remaining structure is the same as that of Embodiment 1.

As described above, the motor housing 202 is provided with the through hole 212 having the large-diameter portion 212*a* open to the inner side of the motor housing 202, in which the hermetic terminal 241 is provided, and the small-diameter portion 212*b* passing from the large-diameter portion 212*a* to the inverter housing chamber 208 which is the outside of the motor housing 202. As a result, the stepped portion 212*c* is formed between the large-diameter portion 212*a* and the small-diameter portion 212*b*. The configuration is provided so that the stepped portion 212*c* prevents the hermetic terminal 241 from passing through the through hole 212 to fall into the inverter housing chamber 208. Therefore, even if internal pressure of the motor housing 202 is increased during the operation of the electric compressor 201, the hermetic terminal 241 does not pass to the outside of the motor housing 202. On the other hand, the movement of the hermetic terminal 241 from the outer side of the motor housing 202 to the inner side is restricted by the front housing 203 provided so as to face the hermetic terminal 241. Therefore, the hermetic terminal 241 does not fall inside the motor housing 202. Specifically, by locating the hermetic terminal 241 in the large-diameter portion 212*a* of the through hole 212 from the inner side of the motor housing 202, the hermetic terminal 241 is retained at the time when the front housing 203 is mounted. The hermetic terminal 241 is retained without using a retainer such as a circlip. Therefore, it is not necessary to form a groove or the like for the retainer on the large-diameter portion 212*a* of the through hole 212. Thus, even in the electric compressor 201 in which the compression mechanism 31, the electric motor 11, and the inverter 206 are sequentially arranged in series along the axial direction, the number of components is reduced, while the number of steps and the amount of time required for assembling the hermetic terminal 241 and for machining the components, are reduced as in the case of Embodiment 1. As a result, the production efficiency can be improved.

Moreover, the front housing 203 is configured to restrict the movement of the hermetic terminal 241 from the outer side of the motor housing 202 to the inner side through the cluster block 241 interposed therebetween. Therefore, the hermetic terminal 241 is prevented from falling to the inner side of the motor housing 202 and the cluster block 244 is prevented from falling from the hermetic terminal 241 by the same configuration.

Embodiment 5

Next, an electric compressor 301 according to Embodiment 5 of the present invention is described. In contrast to the electric compressor 201 according to Embodiment 4, the electric compressor 301 according to Embodiment 5 is configured so as to directly restrict the movement of the hermetic terminal from the outer side of the motor housing to the inner side by the front housing without through the cluster block.

Figure 11:
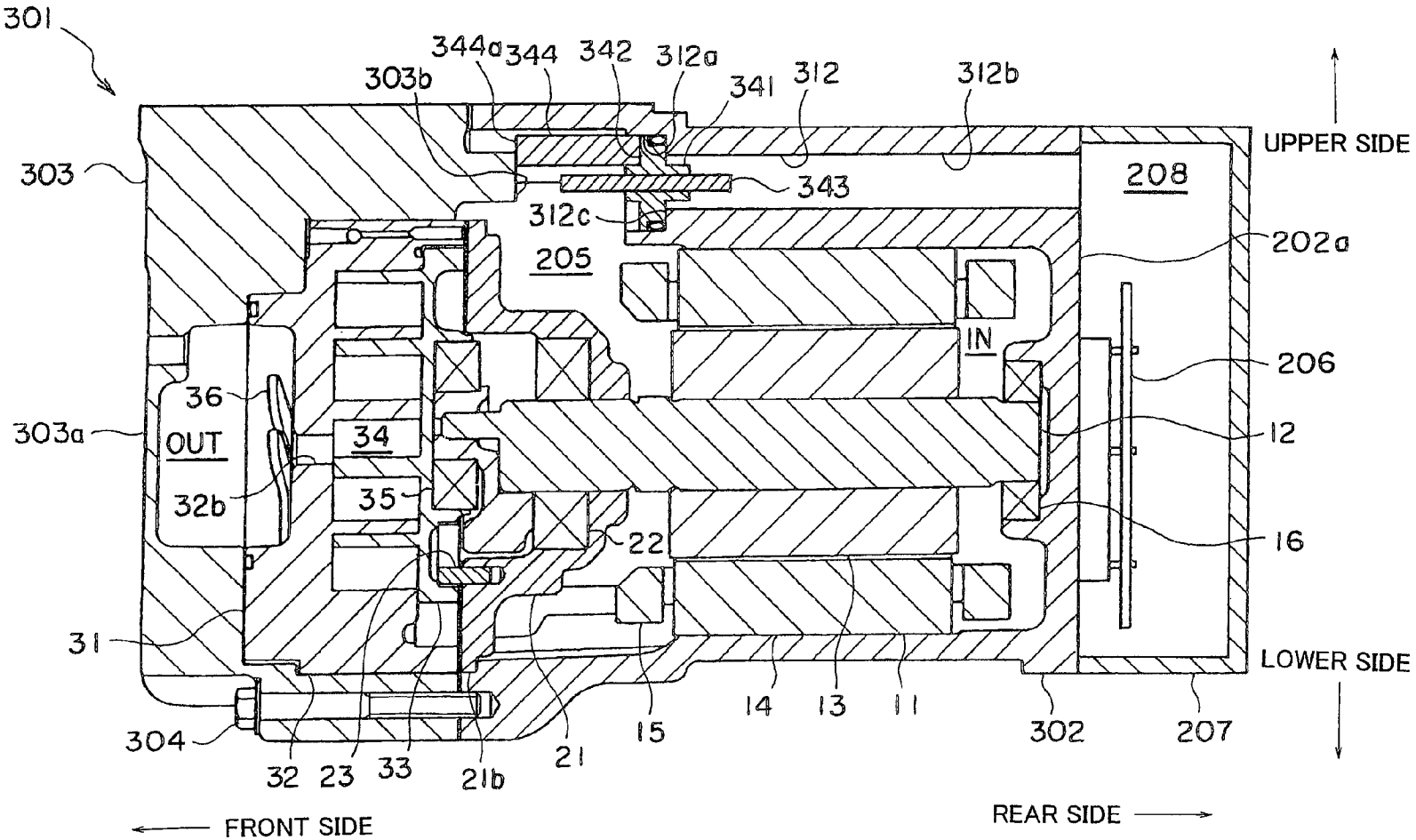
FIG. 11 is a sectional side view illustrating an electric compressor according to Embodiment 5 of the present invention.

As illustrated in FIG. 11, the electric compressor 301 includes a motor housing 302 and a front housing 303 connected to a front end of the motor housing 302 with a plurality of bolts 304. The motor housing 302 is obtained by reducing an axial length size of the motor housing 202 of Embodiment 4. A front end portion of the motor housing 302 ends in the vicinity of the cylindrical portion 21*b* of the shaft supporting member 21. On the other hand, the front housing 303 is an approximately cylindrical member having a bottom portion 303*a* and is open to a rear side. Inside the front housing 303, the compression mechanism 31 is accommodated.

Inside the motor housing 302, similar to the through hole 212 of Embodiment 4, a through hole 312 having a large-diameter portion 312*a* and a small-diameter portion 312*b* is formed. Inside the large-diameter portion 312*a*, a hermetic terminal 341 including a terminal main body 342 and conductive members 343 is provided. The terminal main body 342 is locked to a stepped portion 312*c* between the large-diameter portion 312*a* and the small-diameter portion 312*b*, which prevents the hermetic terminal 341 from passing through the through hole 312 to fall into the inverter housing chamber 208.

Figure 12:
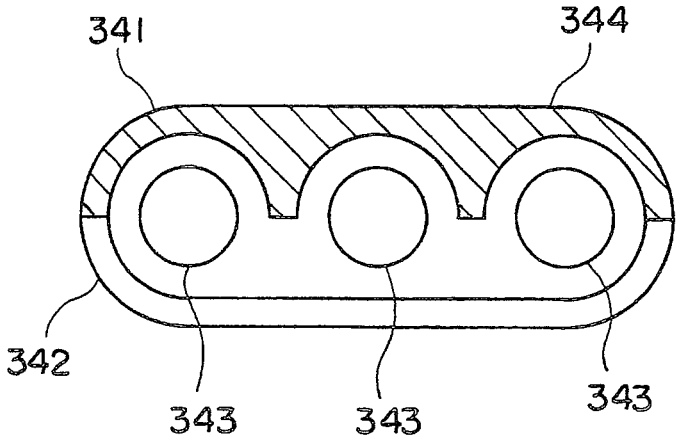
FIG. 12 is a partially enlarged sectional view illustrating the structure around a hermetic terminal in the electric compressor according to Embodiment 5.

Moreover, the hermetic terminal 341 includes an extending member 344 which is integrally provided with the terminal main body 342 and extends toward the front side of the terminal main body 342. As illustrated in FIG. 12, the extending member 344 is a member made of a resin or the like and is integrally fixed to the terminal main body 342 as one body by bonding or insertion molding so as to cover upper sides of the three conductive members 343. Returning to FIG. 11, a front end portion 344*a* of the extending member 344 extends to the vicinity of a rear end surface 303*b* of the front housing 303. Between the front end 344*a* and the rear end surface 303*b*, a small clearance, which does not allow the terminal main body 342 to fall from the large-diameter portion 312*a* of the through hole 312 to the space 5, is formed. Moreover, the conductive members 343 are electrically connected to the electric motor 11 through a connection terminal and a lead wire (both not shown) without using a cluster block. Specifically, the movement of the hermetic terminal 341 of the electric compressor 301 from the outer side of the motor housing 302 to the inner side is directly restricted by an area of the front housing 303, which faces the front end portion 344*a* of the extending member 344.

As described above, even when the front housing 303 is configured to directly restrict the movement of the hermetic terminal 341 from the outer side of the motor housing 302 to the inner side without using a cluster block, the same effects as those of Embodiment 5 can be obtained.

Embodiment 6

Next, an electric compressor according to Embodiment 6 of the present invention is described.

An electric compressor 401 according to Embodiment 6 is configured to restrict the movement of the hermetic terminal from the outer side of the motor housing to the inner side through the cluster block interposed therebetween while using the motor housing 302 and the front housing 303 of Embodiment 5.

Figure 13:
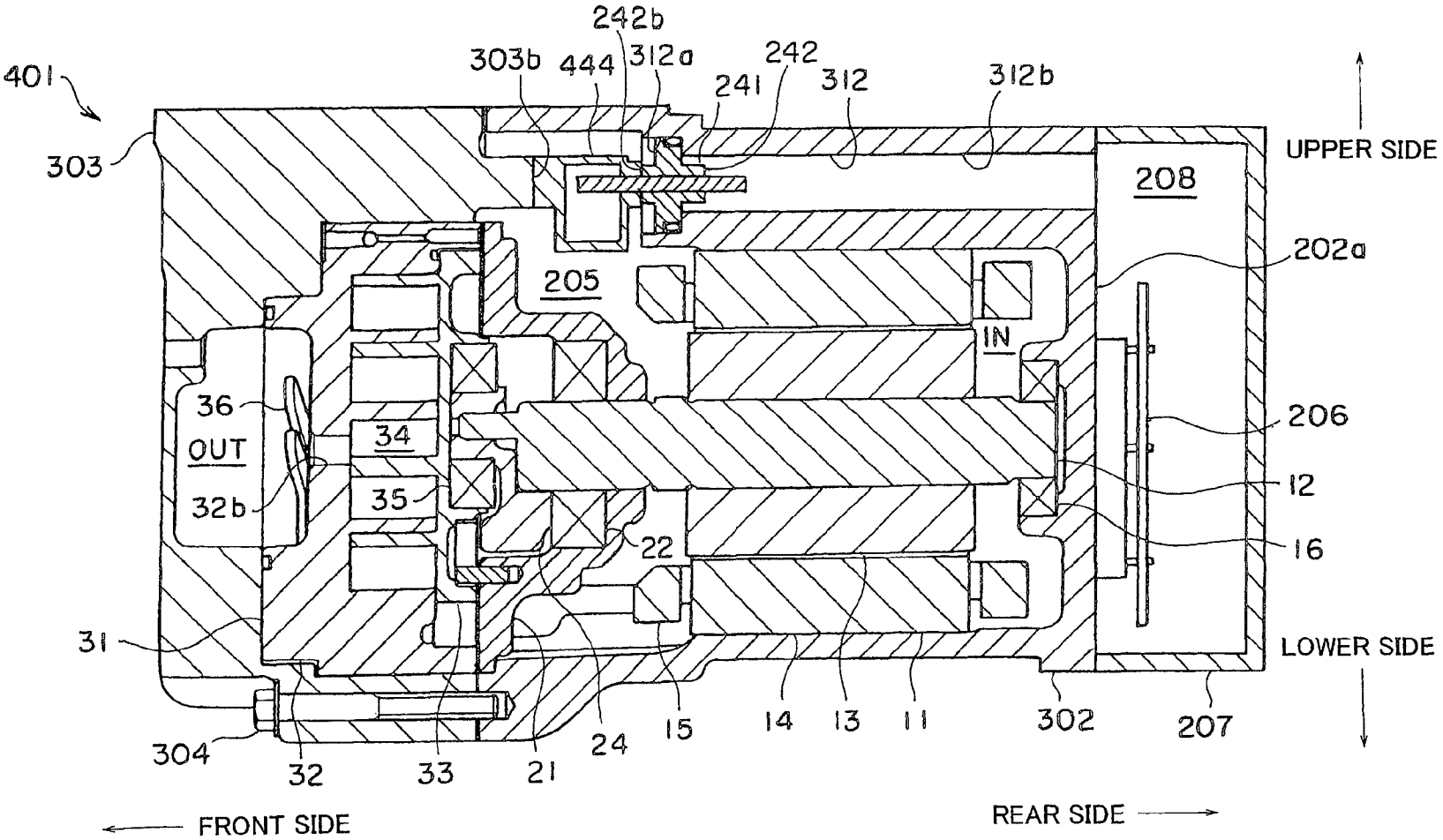
FIG. 13 is a partially enlarged sectional view illustrating the structure around a hermetic terminal in an electric compressor according to Embodiment 6 of the present invention.

As illustrated in FIG. 13, inside a large-diameter portion 312*a* of a through hole 312 provided to the motor housing 302, the hermetic terminal 241 of Embodiment 4 is provided. Moreover, a cluster block 444 is provided between the bottom end surface 242*b* of the terminal main body 242 and the rear end surface 303*b* of the front housing 303, which faces the bottom end surface 242*b*. Specifically, in the electric compressor 401, the front housing 303 restricts the movement of the hermetic terminal 241 from the outer side of the motor housing 302 to the inner side through the cluster block 444 interposed therebetween. The remaining configuration is the same as that of Embodiment 5.

As described above, even when the front housing 303 is configured to restrict the movement of the hermetic terminal 241 from the outer side of the motor housing 302 to the inner side through the cluster block 444 interposed therebetween, the same effects as those of Embodiment 5 can be obtained.

Embodiment 7

Next, an electric compressor according to Embodiment 7 of the present invention is described. In contrast to the electric compressor 201 of Embodiment 4 which uses the front housing 203 as the movement restricting member, an electric compressor 501 according to Embodiment 7 is configured to use a shaft supporting member as the movement restricting member.

Figure 14:
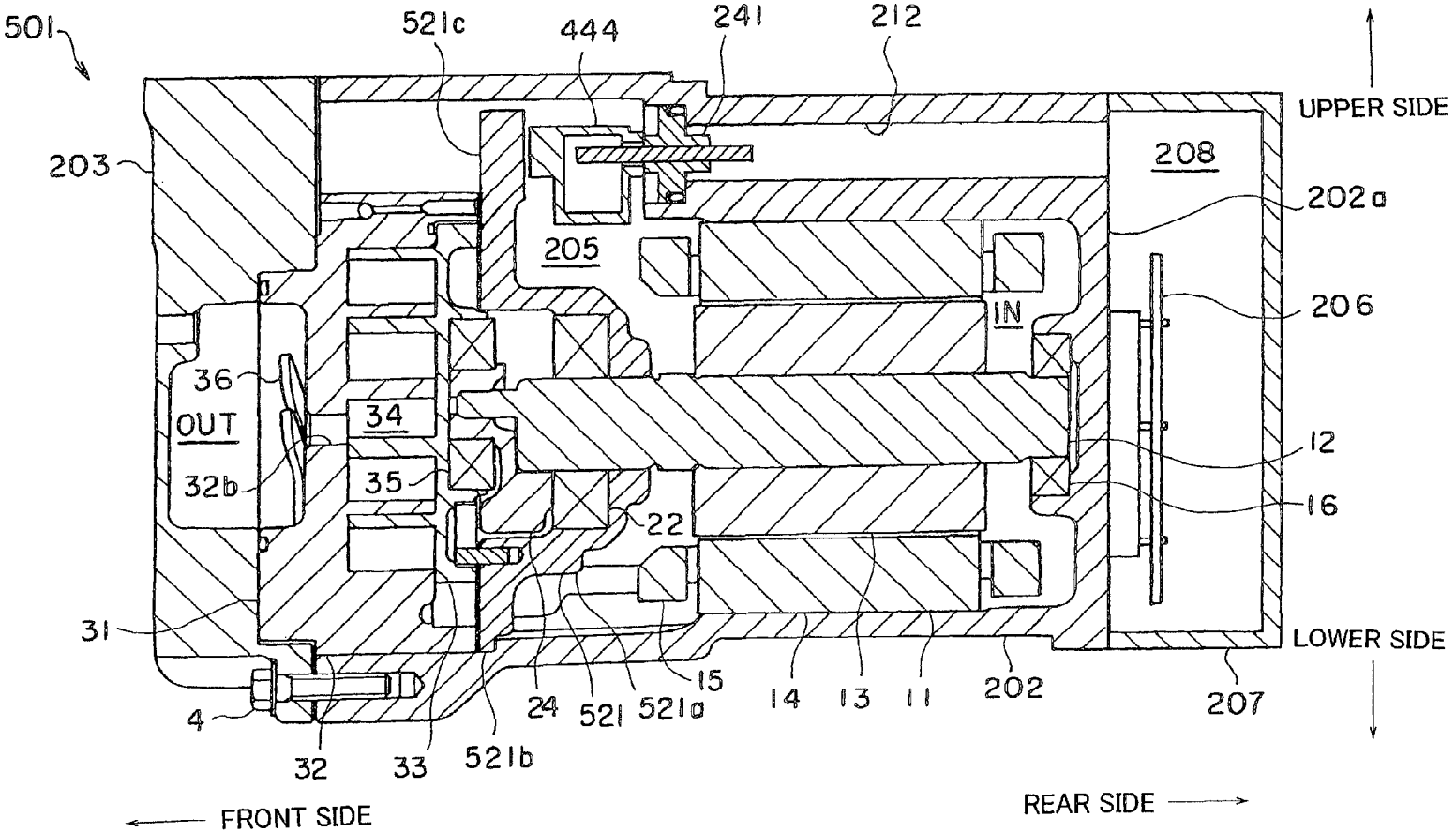
FIG. 14 is a sectional side view illustrating an electric compressor according to Embodiment 7 of the present invention.

As illustrated in FIG. 14, a shaft supporting member 521 for rotatably supporting the drive shaft 12 is provided between the electric motor 11 and the compression mechanism 31. Similar to the shaft supporting member 21 of Embodiment 1, the shaft supporting member 521 is a hollow member having a hexagonal portion 521*a* and a cylindrical portion 521*b*. A part of an upper portion of the cylindrical portion 521*b* projects radially outward to extend to a position so as to face the hermetic terminal 241 to form an opposed projecting portion 521*c*. The opposed projecting portion 521*c* is located so as to face the hermetic terminal 241 through the cluster block 444 of Embodiment 6 interposed therebetween. Specifically, in the electric compressor 501, the movement of the hermetic terminal 241 from the outer side of the motor housing 202 to the inner side is restricted by the opposed projecting portion 521*c* of the shaft supporting member 521. In this case, the shaft supporting member 521 constitutes the movement restricting member in the electric compressor 501. The remaining configuration is the same as that of Embodiment 4.

As described above, even when a part of the shaft supporting member 521 is configured to be located at the position so as to face the hermetic terminal 241, the same effects as those of Embodiment 4 can be obtained.

Embodiment 8

Next, an electric compressor according to Embodiment 8 of the present invention is described. An electric compressor 601 of Embodiment 8 is configured to use a fixed scroll of a compression mechanism as the movement restricting member.

Figure 15:
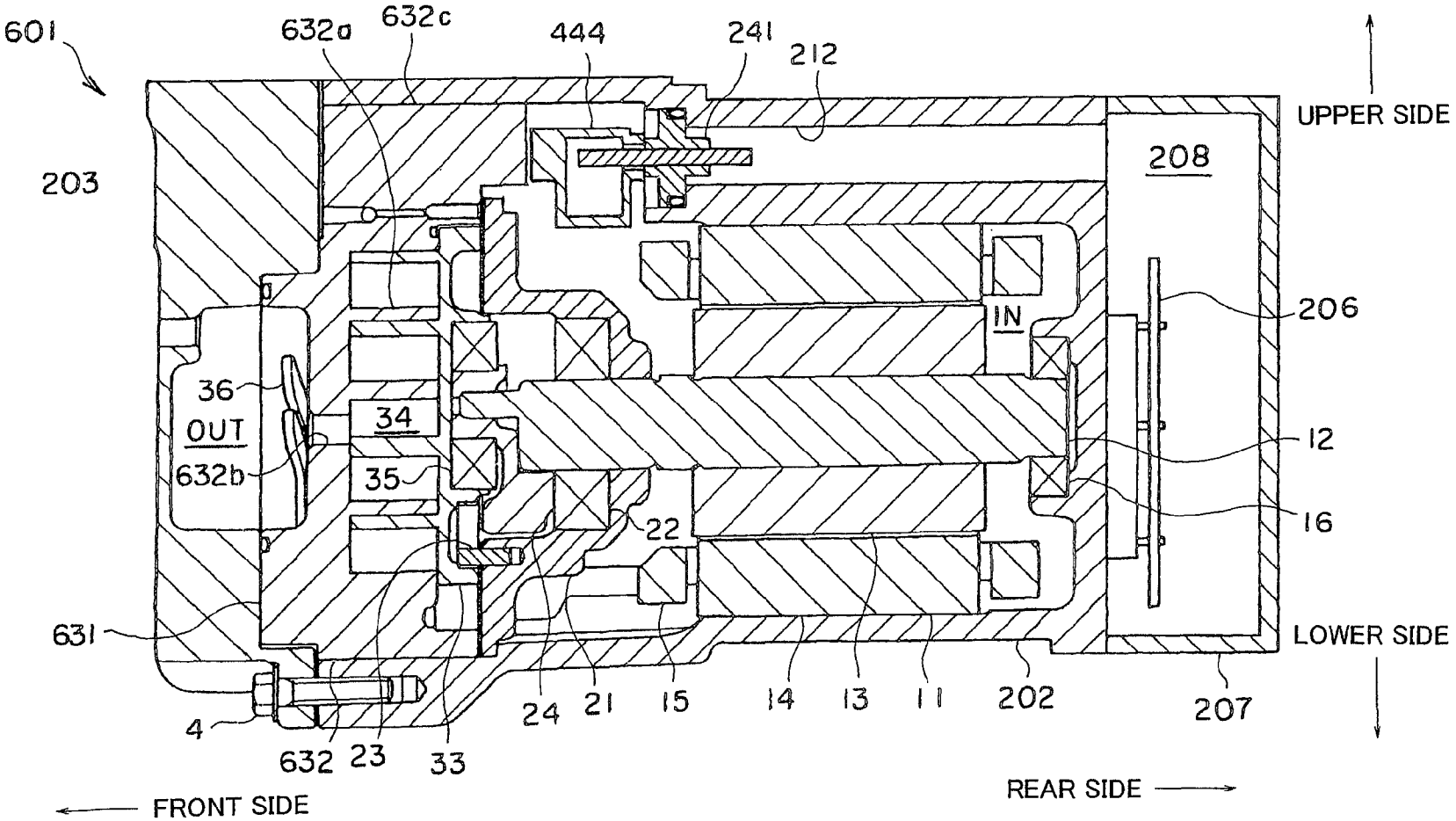
FIG. 15 is a sectional side view illustrating an electric compressor according to Embodiment 8 of the present invention.

As illustrated in FIG. 15, a compression mechanism 631 of the electric compressor 601 includes a fixed scroll 632 and the orbiting scroll 33. In contrast to the fixed scroll 32 of Embodiment 1, a part of an upper portion of the fixed scroll 632 projects radially outward to extend to the position so as to face the hermetic terminal 241. The projecting part forms an opposed projecting portion 632*c*.

The opposed projecting portion 632*c* is provided so as to face the hermetic terminal 241 through the cluster block 444 interposed therebetween. Specifically, in the electric compressor 601, the movement of the hermetic terminal 241 from the outer side of the motor housing 202 to the inner side is restricted by the opposed projecting portion 632*c* of the fixed scroll 632. In this case, the fixed scroll 632 constitutes the movement restricting member in the electric compressor 601.

Moreover, the fixed scroll 632 includes a fixed lap 632*a* and a discharge port 632*b*, which are similar to the fixed lap 32*a* and the discharge port 32*b* of the fixed scroll 32 of Embodiment 1. The remaining configuration is the same as that of Embodiment 4.

As described above, even when a part of the fixed scroll 632 of the compression mechanism 631 is configured to be located at the position so as to face the hermetic terminal 241, the same effects as those of Embodiment 4 can be obtained.

The electric compressor has been described as including the scroll-type compression mechanism in Embodiments 1 to 8. However, the electric compressor can include other type of compression mechanism as long as the electric compressor is configured to use a hermetic terminal, and therefore the compression mechanism is not limited to a scroll-type.

Moreover, the flange portion is formed over the entire circumference of the side wall of the terminal main body of the hermetic terminal in Embodiments 1 to 3. However, the area of formation of the flange portion is not intended to be limited. The flange portion can also be formed to only partially project.

Further, in Embodiments 4 to 8, the through hole 212 includes the large-diameter portion 212*a* and the small-diameter portion 212*b*, and the hermetic terminal 241 is locked to the stepped portion 212*c* between the large-diameter portion 212*a* and the small-diameter portion 212*b*. The through hole 312 includes the large-diameter portion 312*a* and the small-diameter portion 312*b*, and the hermetic terminal 341 is locked to the stepped portion 312*c* between the large-diameter portion 312*a* and the small-diameter portion 312*b*. However, the through holes 212 and 312 do not need to include the large-diameter portions 212*a* and 312*a* and the small-diameter portions 212*b* and 312*b*, respectively, as long as the hermetic terminal includes any one of the flange portions 42*b*, 52*b*, and 62*c* which are the pass preventing portion as in Embodiments 1 to 3.

Although the tapered portion 62*b* is formed on the side wall 62*a* of the terminal main body 62 of the hermetic terminal 61 in Embodiment 3, a tapered portion may be formed on the side wall of the terminal main body of the hermetic terminal even in Embodiments 1, 2, and 4 to 8.

The invention claimed is:

1. An electric compressor, comprising:

a compression mechanism for compressing a refrigerant and discharging the compressed refrigerant;

an electric motor including a drive shaft, for driving the compression mechanism through the drive shaft;

a housing for accommodating the compression mechanism and the electric motor;

a hermetic terminal for supplying electric power from outside of the housing to the electric motor, the hermetic terminal including a terminal main body and conductive members, the terminal main body being fully contained inside the housing;

the housing includes a through hole in which the hermetic terminal is located;

a sealing device disposed inside the housing for maintaining airtightness in the housing is provided between the hermetic terminal and the housing;

the hermetic terminal includes a pass preventing portion located inside the housing which is configured to prevent the hermetic terminal from moving out of the through hole in a direction from the inside of the housing to an outside of the housing; and a cluster block disposed in the housing, for electrically connecting the electric motor and the hermetic terminal to each other, wherein the cluster block and the housing are configured to restrain movement of the hermetic terminal.

2. An electric compressor according to claim 1, wherein:

the pass preventing portion of the hermetic terminal is a flange portion of the hermetic terminal provided so as to project outward from the terminal main body; and the flange portion and an inner circumferential surface of the housing are brought into contact with each other to prevent the hermetic terminal from falling through the through hole.

3. An electric compressor according to claim 2, wherein:

a projecting portion is provided in the housing so as to face the flange portion of the hermetic terminal;

the flange portion has an asymmetrical shape having different amounts of projection and includes a mis-assembly preventing portion having the smaller amount of projection; and the mis-assembly preventing portion is located so as to have a correspondence relation with the projecting portion.

4. An electric compressor according to claim 1, wherein a tapered portion to be fitted into the through hole is provided to at least a part of the hermetic terminal located inside the through hole.

5. An electric compressor according to claim 1, further comprising an inverter, wherein the hermetic terminal is disposed in the housing between a scroll of the compression mechanism and the inverter, as viewed along an axial direction of the housing.

6. An electric compressor, comprising:

a compression mechanism for compressing a refrigerant and discharging the compressed refrigerant;

an electric motor for driving the compression mechanism;

a housing for accommodating the compression mechanism and the electric motor; and a hermetic terminal for supplying electric power from outside of the housing to the electric motor while maintaining airtightness in the housing, wherein the hermetic terminal includes a terminal main body and conductive members, and the terminal main body is fully contained inside the housing;

the housing including a through hole having a large-diameter portion being open to inside of the housing, in which the hermetic terminal is located, and having a small-diameter portion passing through from the large-diameter portion to outside of the housing;

the housing including a stepped portion between the large-diameter portion and the small-diameter portion of the through hole;

the hermetic terminal is retained in the large-diameter portion of the through hole without using a retainer by locating the hermetic terminal in the large-diameter portion of the through hole from an inner side of the housing so that a first end surface of the hermetic terminal faces the stepped portion; and a cluster block disposed in the housing, wherein the cluster block and the housing are configured to restrict movement of the hermetic terminal.

7. An electric compressor according to claim 6, further comprising an inverter, wherein the hermetic terminal is disposed in the housing between a scroll of the compression mechanism and the inverter, as viewed along an axial direction of the housing.

* * * * *